United States Patent [19]

Ramsay

[11] Patent Number: 5,005,743

[45] Date of Patent: Apr. 9, 1991

[54] TELESCOPIC CARRYING CASE

[76] Inventor: Richard P. Ramsay, 19A Abbeville Road, London, Great Britain, SW4 9LA

[21] Appl. No.: 406,070

[22] Filed: Sep. 12, 1989

[30] Foreign Application Priority Data

Sep. 15, 1988 [GB] United Kingdom ..... 8821609

[51] Int. Cl.[5] ..... A45C 7/00; B65D 6/12

[52] U.S. Cl. ..... 224/202; 224/917; 224/922; 224/251; 190/104; 190/105; 220/8

[58] Field of Search ..... 224/922, 917, 202, 235, 224/250–252, 264–266, 258; 190/104, 105; 206/315.1, 315.3, 315.4, 315.11; 220/8

[56] References Cited

U.S. PATENT DOCUMENTS

| | | | |
|---|---|---|---|
| 1,352,238 | 9/1920 | Arther | 220/8 |
| 1,727,578 | 9/1929 | Wengard | 224/205 |
| 1,903,798 | 4/1933 | Turner | 224/922 |
| 2,437,405 | 3/1948 | Robbinson | 294/137 |
| 2,707,009 | 4/1955 | Cook | 224/202 |
| 2,803,322 | 8/1957 | Nathan | 190/104 |
| 2,867,257 | 1/1959 | Cart | 206/315.3 |
| 2,919,017 | 12/1959 | Weber | 220/8 |
| 3,263,806 | 8/1966 | Ring | 224/202 |
| 3,316,951 | 5/1967 | Jacobson | 206/315.4 |
| 3,757,911 | 9/1973 | Dotter | 190/57 |
| 3,837,548 | 9/1977 | Nerger | 224/455 |
| 3,921,871 | 11/1975 | Heil | 224/917 |
| 3,985,171 | 10/1976 | Summers et al. | 206/315.4 |
| 4,091,977 | 5/1978 | Luttbeg | 206/315.3 |
| 4,161,268 | 7/1979 | Heil | 224/455 |
| 4,191,233 | 3/1980 | McKay | 150/52 R |
| 4,380,290 | 4/1983 | Luebke | 206/315 R |
| 4,643,302 | 2/1987 | Baumgardner | 190/105 |
| 4,715,416 | 12/1987 | Horne | 190/104 |
| 4,746,159 | 5/1988 | Webb et al. | 294/147 |
| 4,915,221 | 4/1990 | Spangler | 206/315.3 |

FOREIGN PATENT DOCUMENTS

| | | |
|---|---|---|
| 0182690 | 5/1986 | European Pat. Off. . |
| 2132731 | 1/1973 | Fed. Rep. of Germany . |
| 2210833 | 9/1973 | Fed. Rep. of Germany . |
| 585124 | 1/1947 | United Kingdom . |

*Primary Examiner*—Henry J. Recla
*Assistant Examiner*—Keith Kupferschmid
*Attorney, Agent, or Firm*—Merchant & Gould

[57] ABSTRACT

A telescopic carrying case comprising two sleeves, a securing strap, a shoulder strap and carrying handle. The inner sleeve slides into the outer sleeve. The securing strap runs from a bar which is positioned on the end of the inner sleeve so that there are no protrusions along the length of the sleeve which would prevent the inner sleeve from being fully inserted into the outer sleeve. The handle is positioned along a length of the outer sleeve so that a hand may be clasped around the handle on the exact center of gravity of the loaded carrying case regardless of the length of object placed within the case. The lug to which the shoulder strap is attached is positioned so that when the case is slung in an upright position from the carrier's shoulder the carrying handle snuggles beneath the carrier's armpit and does not push against the carrier's collar bone.

7 Claims, 3 Drawing Sheets

TELESCOPIC CARRYING CASE

FIELD OF THE INVENTION

This invention relates to a telescopic carrying case.

BACKGROUND OF THE INVENTION

Telescopic carrying cases are known for accommodating articles of which the length may differ between types of the same article. For example DE-A-2210833 describes a case for carrying skis and which comprises upper and lower case parts, the lower case part receiving the skis and the upper part sliding over the open end of the lower part to house the skis. A strap with a buckle secures the upper and lower case parts. The case is designed to be secured to a roofrack. U.S. Pat. No. 4,161,268 describes a three part case for skis, the three parts being arranged in telescopic relation and adjustable stepwise to conform to differing length skis. The case can be carried by a small cut out hand grip area or by a shoulder strap.

A significant problem with these cases is that they are awkward to carry. The cases are designed to accommodate different lengths of skis but no account is taken of the effect that different lengths of skis have on the weight distribution characteristics of the case.

As the contents vary in length and the case is telescopic, the position of the centre of gravity in relation to the container portions is not fixed. This presents difficulties in determining the position of a handle or strap.

It is an object of the invention to provide a telescopic carrying case which takes account of the differing weight distribution characteristics arising from different lengths of article and thereby renders the case more comfortable to carry.

BRIEF SUMMARY OF THE INVENTION

According to the present invention there is provided a carrying case comprising: first and second container portions arranged in telescopic relation with the first container portion slidable over the mouth of the second container portion to form a case of variable length; means for securing said container portions one to the other at a length of case selected according to the contents of the case; and a rigid handle provided on the first portion and extending between a first position adjacent the mouth of the first portion to a second position spaced therefrom by a distance such that the length of the handle is sufficient to extend over all centres of gravity which might arise in use of the case for carrying goods of differing lengths.

A user's hand can hence be placed in the correct position over the centre of gravity.

The handle is such therefore that it can always be grasped above the centre of gravity of the loaded case, the position of which is determined not by the case, but by the length of its contents.

The case is suitable for all classes of goods of which the length may differ between types. Skis and fishing rods are good examples of such goods.

In the preferred embodiment, the two container portions are fastened together securely by a webbing strap of adjustable length. The strap runs from the closed end of the second container portion and carries a quick release device in the form of a trigger clip. A buckle and three bar slide enable the length of the strap to be adjusted. The trigger clip cooperates with an eye, located on the first container portion near its mouth, to secure the case against opening. Once the length of the strap has been adjusted to a particular length of skis, no further adjustment is required to reuse the case: the trigger clip and eye supplies the necessary securement at the preselected length.

Preferably, the strap is attached to a bar running across the closed end of the second container portion.

Preferably a shoulder strap is provided, which is secured at one end by a trigger clip cooperating with an eye on a lug on the first container portion near its mouth, this eye being adjacent the eye provided for the securing strap and at the other end by a trigger clip cooperating with an eye provided on the first container portion. Preferably, this latter eye is positioned a distance from the carrying handle toward the closed end of the first container portion so that when the case is slung in an upright position from the carrier's shoulder the carrying handle snuggles beneath the carrier's armpit and does not push against the carrier's collar bone. This enables the case to be carried comfortably and securely.

DESCRIPTION OF THE PREFERRED EMBODIMENT

Figure 1:
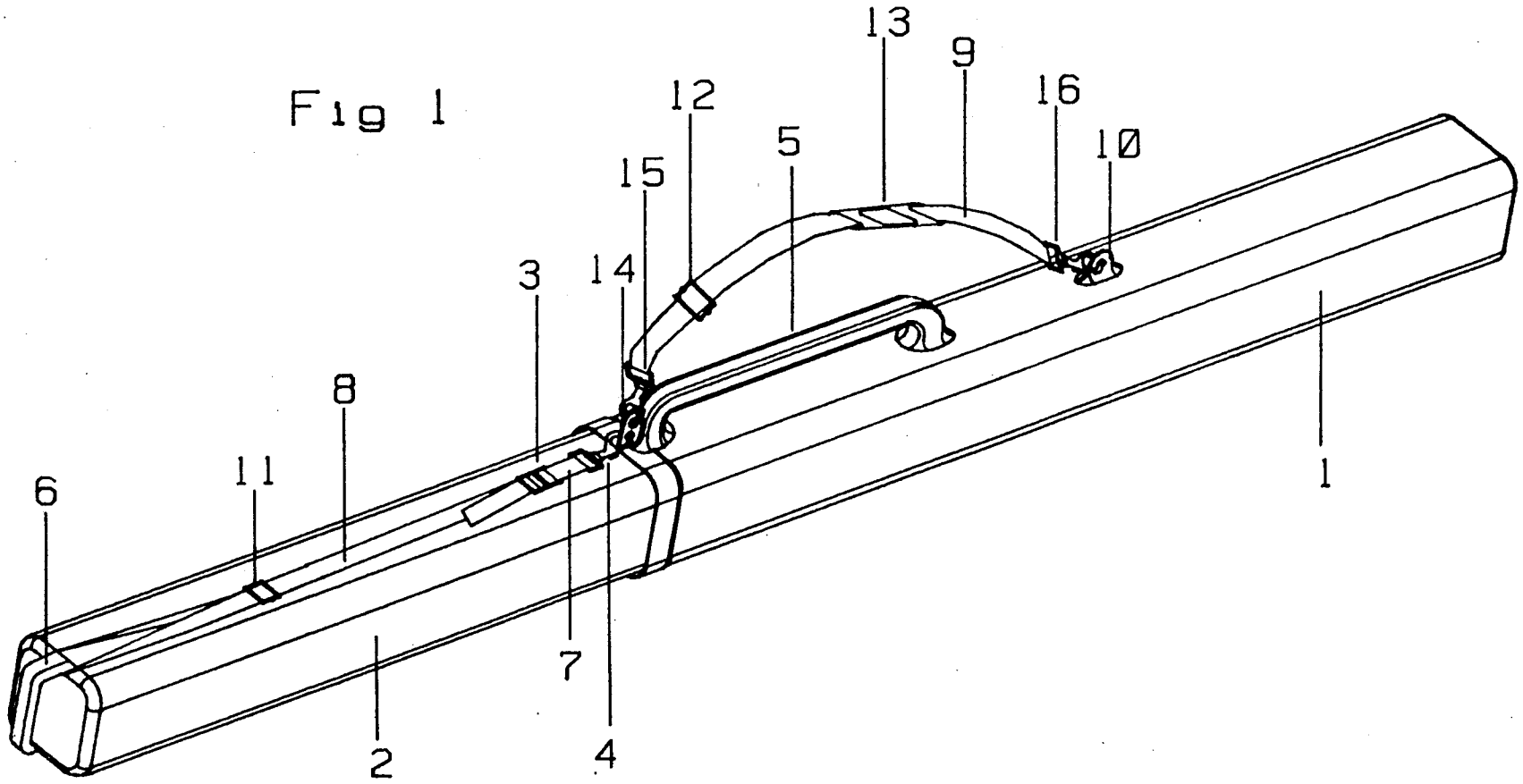
FIG. 1 shows a complete assembled telescopic carrying case.

For a better understanding of the present invention and to show how the same may be carried into effect, reference will now be made by way of example to the accompanying drawings in which:

Referring to FIG. 1, a telescopic carrying case comprises a first container portion or outer sleeve 1 and a second container portion or inner sleeve 2. The inner sleeve 2 has a bar 6 extending across its base around which passes a strap 8. The strap 8 passes through a three bar slide 11 for adjusting the length of the strap and extends lengthwise of the inner sleeve 2. The strap 8 can be held tight by a buckle 3. This buckle 3 is secured by a short length of strap 7 to a trigger clip 4. The inner sleeve 2 can be manufactured from a plastics material by blow moulding, and the bar 6 can be integrally moulded during this process.

The bar 6 is positioned on the end of the inner sleeve 2 so that there are no protrusions along the length of the sleeve 2 which would prevent the inner sleeve 2 from being fully inserted into the outer sleeve 1. The empty carrying case would normally be stored in this fashion.

The outer sleeve 1 is similarly formed by blow moulding and there is formed integrally therewith a carrying handle 5.

The position of the two anchoring ends of the integral carrying handle 5 are as follows. A first anchoring end of the carrying handle 5 is positioned close to the mouth of the outer sleeve 1. The outer sleeve 1 is longer than the inner sleeve 2. This is so that with a long pair of skis for example inside the case and the inner sleeve 2 inserted so that there is a reasonable overlap between the two sleeves, the inner face of the first end of the carrying handle 5 is positioned sufficiently beyond the loaded case's centre of gravity so that a hand may be placed exactly at that centre of gravity.

The second end of the handle 5 is positioned a distance along the outer sleeve 1 so that with a short pair of skis in the case, the inner face of the second end of the carrying handle 5 is positioned sufficiently beyond the centre of gravity of the loaded case to allow a hand to be placed exactly at the centre of gravity. The handle 5 thus extends over all possible centres of gravity of the loaded case.

A lug 10 with an eye for securing a shoulder strap 9 having a trigger clip 16 is positioned a distance from the second end of the carrying handle 5 toward the closed end of the outer sleeve 1 so that when the case is slung in an upright position from the carrier's shoulder the carrying handle 5 snuggles beneath the carrier's armpit and does not push against the carrier's collar bone. The other end of the shoulder strap 9 is secured to an eye of a lug 14, located near the mouth of the outer sleeve 1, by a trigger clip 15. The strap 9 has a three bar slide 12 for adjusting its length and a shoulder pad 13.

The lug 14 has a further eye to which is secured the trigger clip 4 of the strap 8 to close the case over its contents securely so that the two sleeves cannot be caused to separate by the force of the skis moving within the case.

To remove the skis from the case all that is required is to uncouple the trigger clip 4 from the further eye of the lug 14 on the carrying handle 5, and withdraw the inner sleeve 2 from the outer sleeve 1.

Figure 2:
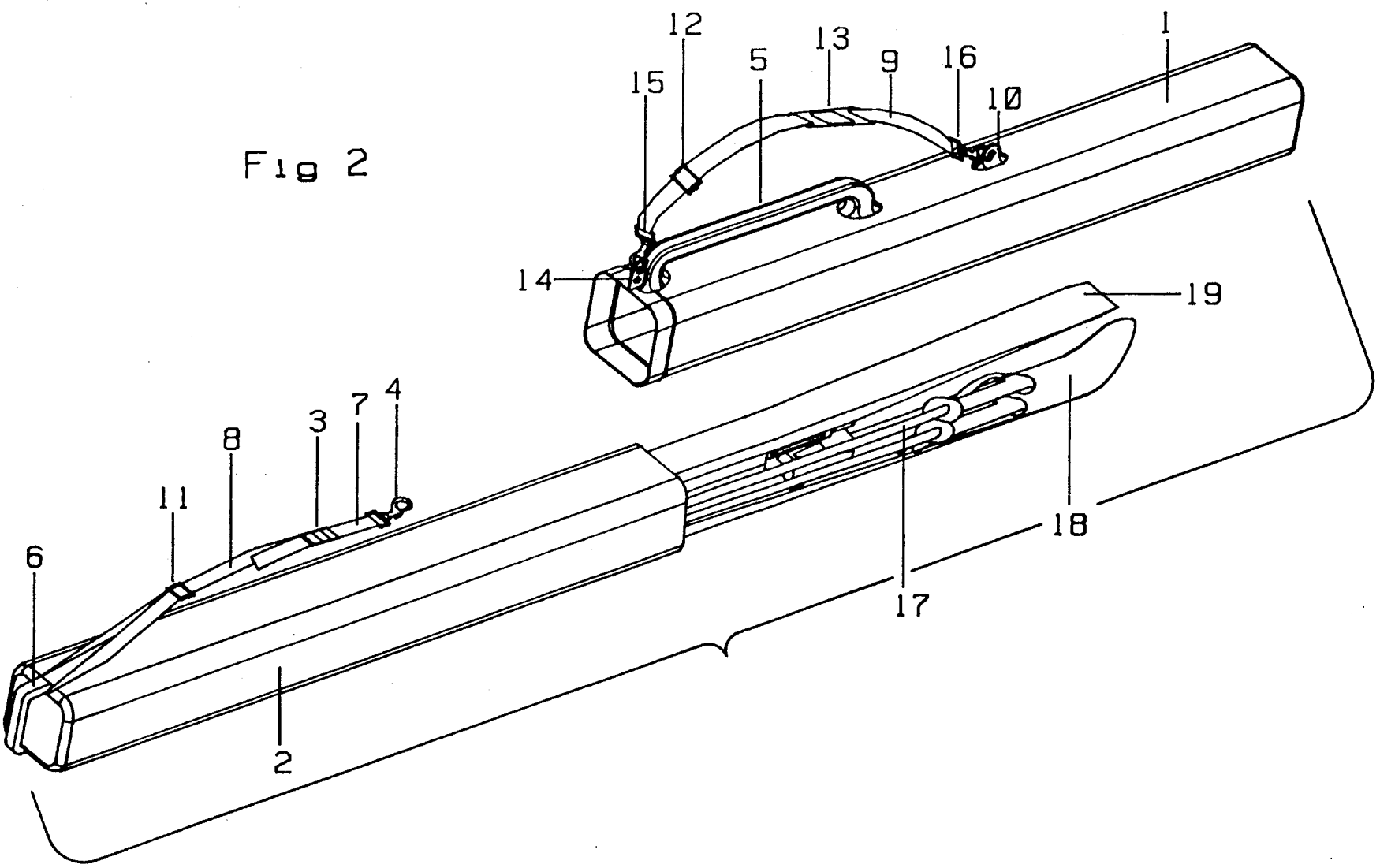
FIG. 2 shows the two container portions separated, with the second container portion containing skis.
Figure 3:
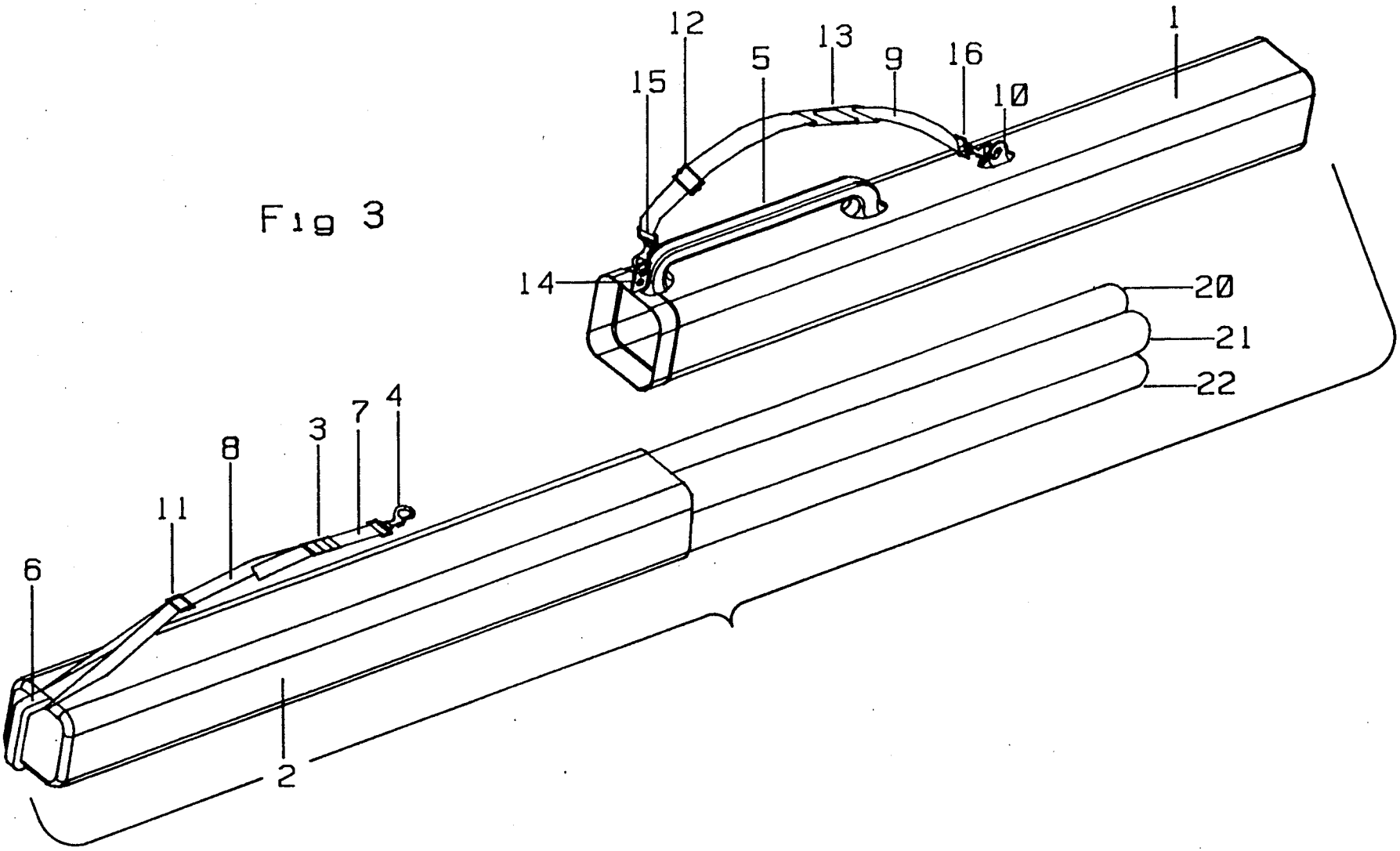
FIG. 3 shows the container portions separated, with the second container portion containing fishing rod cylinders.

FIG. 2 shows the case used for carrying skis 18,19 and ski poles 17, while FIG. 3 shows the case used for carrying fishing rods (which are housed by cylinders 20,21,22 of aluminium, perspex or other similar materials). For articles of shorter lengths than skis or fishing rods for example, it may be necessary to make the handle 5 on the outer sleeve 1 longer than shown in the drawings. Hence the second end of the handle 5 would be closer to the closed end of the outer sleeve 1 so as to ensure that the handle 5 extends over all centres of gravity which might arise in use of the case with such shorter articles.

In an alternative embodiment (not shown) the shoulder strap 9 is secured by passing around the bar 6 instead of to the eye of the lug 14.

What is claimed is:

1. A carrying case comprising: first and second container portions each having an open end and a closed end and arranged in telescopic relation with the first container portion slidable over the open end of the second container portion to form a case of variable length, the first container portion being of a length such that the first container portion is capable of sliding over the entire second container portion; means for securing said container portions one to the other at a position selected according to the contents of the case; and a rigid handle provided on the first portion and extending between a first position adjacent said open end of the first portion to a second position spaced therefrom by a distance such that the length of the handle is sufficient to extend over all centres of gravity which arise when using the case for carrying goods of differing lengths, wherein the securing means comprises a strap of adjustable length having a first end attached to a bar extending across the entire closed end of the second container portion, and a second opposite end constructed and arranged to selectively engage said first container portion such that said strap releasably secures said second container portion to said first container portion.

2. A case according to claim 1 wherein the strap carries a quick release device which cooperates with an attachment provided on the first container portion to secure the case when closed.

3. A case according to claim 2 wherein the quick release device is a trigger clip and the attachment is a lug providing an eye for said clip.

4. A case according to claim 1 comprising a shoulder strap having a first and second ends wherein the first end of the shoulder strap is secured to the first container portion at a distance from the rigid handle in a direction towards the closed end of the first container portion so that when the case is slung in an upright position from the carrier's shoulder the carrying handle snuggles beneath the carrier's armpit and does not push against the carrier's collar bone, and wherein the second end of the shoulder strap is secured adjacent the open end of the first container portion.

5. A case according to claim 1 wherein at least one of the first and second container portions is formed by blow moulding.

6. A case according to claim 1 in which the handle is formed integrally with the first container portion.

7. A carrying case according to claim 1, wherein said bar is integrally formed with the second container portion.

* * * * *